US009719162B2

(12) United States Patent
Anderhuber et al.

(10) Patent No.: US 9,719,162 B2
(45) Date of Patent: Aug. 1, 2017

(54) METHOD FOR DIP COATING A STEEL STRIP AND FACILITY FOR IMPLEMENTING SAME

(75) Inventors: Marc Anderhuber, Saulny (FR); Alain Daubigny, Villerupt (FR)

(73) Assignee: ARCELORMITTAL INVESTIGACIÓN Y DESARROLLO, S.L., Sestao (ES)

( * ) Notice: Subject to any disclaimer, the term of this patent is extended or adjusted under 35 U.S.C. 154(b) by 259 days.

(21) Appl. No.: 14/352,881

(22) PCT Filed: Oct. 20, 2011

(86) PCT No.: PCT/FR2011/052456

§ 371 (c)(1),
(2), (4) Date: Jun. 24, 2014

(87) PCT Pub. No.: WO2013/057385

PCT Pub. Date: Apr. 25, 2013

(65) Prior Publication Data

US 2014/0329033 A1 Nov. 6, 2014

(51) Int. Cl.

| | |
|---|---|
| ***C23C 2/00*** | (2006.01) |
| ***C23C 2/40*** | (2006.01) |
| *C23C 2/06* | (2006.01) |

(52) U.S. Cl.

CPC ..... *C23C 2/40* (2013.01); *C23C 2/003* (2013.01); *C23C 2/06* (2013.01)

(58) Field of Classification Search

CPC ..... C23C 2/003; C23C 2/06; C23C 2/40
See application file for complete search history.

(56) References Cited

U.S. PATENT DOCUMENTS

| | | | | |
|---|---|---|---|---|
| 4,993,477 A * | 2/1991 | Praeg | ..... | B22D 11/18 164/155.3 |
| 6,187,257 B1 * | 2/2001 | Heine | ..... | C23C 2/003 266/205 |

FOREIGN PATENT DOCUMENTS

| | | | | |
|---|---|---|---|---|
| BE | WO 2008067620 A1 * | 6/2008 | ..... | C23C 2/003 |
| CN | 1730712 A | 2/2006 | | |
| CN | 101033532 A | 9/2007 | | |
| CN | 102168238 A | 8/2011 | | |
| EP | 0949749 A1 | 10/1999 | | |
| JP | S4826632 A | 4/1973 | | |

(Continued)

OTHER PUBLICATIONS

English Translation of JP54033234A.*

*Primary Examiner* — David Turocy
(74) *Attorney, Agent, or Firm* — Davidson, Davidson & Kappel, LLC; Jennifer L. O'Connell

(57) ABSTRACT

A method for hot-dip coating of a steel strip running in a bath of liquid metal such as zinc, or metal alloy contained in a pan is provided. Dross which are formed during the coating and float at the surface of the bath are moved away from the surface of the strip by at least one inductor. Each inductor produces a sliding electromagnetic field oriented along a given direction and generates a magnetomotive force, and the magnetomotive forces displaced the dross towards a container intended to collect them and/or towards an area of the surface of the bath from which they are discharged. For at least one of the inductors, the direction of the respective sliding electromagnetic field is reversed intermittently so as to modify the flows of the dross inside the pan. A hot dip coating facility is also provided.

13 Claims, 4 Drawing Sheets

(56) References Cited

FOREIGN PATENT DOCUMENTS

| | | | | | |
|---|---|---|---|---|---|
| JP | 5433234 | A | | 3/1979 | |
| JP | 54033234 | A | * | 3/1979 | ..... C23C 2/003 |
| JP | 1053850 | A | | 2/1998 | |
| JP | 11006046 | | | 1/1999 | |
| JP | 11006046 | A | | 1/1999 | |
| JP | 2005068545 | A | | 3/2005 | |

* cited by examiner

METHOD FOR DIP COATING A STEEL STRIP AND FACILITY FOR IMPLEMENTING SAME

The invention relates to the steel industry, and more particularly to facilities for hot-dip coating steel strips, through which said strips are covered with a zinc or zinc alloy layer (in the case of galvanization), or with another type of metal or metal alloy such as an aluminum-silicon alloy.

BACKGROUND

It is recalled that during hot-dip coating of a steel strip, the running strip passes into a pan containing the coating metal or metal alloy, maintained in the liquid state. The coating is deposited on the strip which then emerges from the bath, and passes through a device controlling the thickness of the coating and contributing to its solidification, generally formed by nozzles projecting gas onto the surface of the coating. Before its penetration into the bath, the strip is heated up with an annealing oven and then cooled to a temperature close to the temperature of the bath in order to generate optimum adherence conditions between the strip and the coating.

During the crossing of the bath, within the bath, formation of oxides and intermetallic precipitates occurs, essentially based on Zn and Fe in the case of a galvanization bath, containing liquid zinc which will be considered in a preferential manner in the following of the description, without its being an exclusive application of the invention. These precipitates are called "dross". Certain dross have a higher density than that of the bath, and decant at the bottom of the pan without interfering with the galvanization process. Others, on the other hand, have a lower density than that of the bath and float at its surface. They may be incorporated to the coating of the strip, and therefore may generate defects therein. These low density dross, which will be the only ones considered in the following of the text, should therefore be as far away as possible from the area where the strip enters the bath (if this entrance is carried out in the open air, which is not always the case) and from the area where the strip exits out of the bath, and be removed from the pan gradually as they are formed.

For this purpose, most conventionally, an operator standing near the pan pushes, with a tool, the dross towards a container located away from the entrance and exit areas of the strip, this container then being extracted from the pan and emptied by means of an automated system or not. In other cases, the operator pushes the dross towards an area of the pan where a device such as a robot discharges them towards a container outside the pan, in which they are collected.

This operation is uncomfortable and potentially dangerous for the operator, since he/she has to stand in close proximity to a bath of hot liquid metal, with the inconveniences and risks related to the heat and to the possibility of projections of the liquid metal. Moreover the system for controlling the coating thickness deposited on the strip, consists of blowing nozzles, and may use inert gases such as nitrogen in order to limit oxidation of the coating. The use of these inert gases is also a source of risks for the operator, because of the lack of oxygen in the atmosphere around the pan which this involves.

Further, this operation for cleaning the dross imposes a limit on the running speed of the strip, since high speed promotes production of dross, for which the operator and the robot should have time for their removal.

Also, the higher the speed of the strip, the more the nozzles for controlling the coating thickness have to project a substantial amount of gas for maintaining the coating thickness constant. This has the effect of increasing the ambient temperature around the bath, since the blowing gas conveys heat from the strip and the bath towards the working area of the operators.

Finally, in order to limit the thermal energy losses related to the heating of the bath, it is contemplated that certain new coating facilities are entirely encased. It would therefore be necessary, in this case, to limit external interventions and notably that of an operator for removing dross, in order to avoid too frequent removals of covers of the facility.

There is therefore a need for increasing the safety, the rapidity and the efficiency for removing the dross as compared with this conventional technique, without however radically changing the actual galvanization method and the general design of the facility which applies it.

A solution devised by certain steelmakers has been to at least essentially replace human intervention for bringing the dross into the action area of the robot, with the action of electromagnetic devices. By means of sliding fields generated by inductors such as linear motors, electromagnetic forces, to which the metal or liquid metal alloy are sensitive (so-called "magnetomotive forces"), causes displacement of the metal or liquid metal alloy which carries away the dross into the area of the pan where the robot is active, by generating a dross recirculation path for leading them into said area. Such devices are for example described in documents JP-A-10-053850, JP-A-54-33234, JP-A-2005-068545, JP-11-006046.

JP-A-54-33234, for example, teaches that inductors with a sliding field should be positioned all around the strip in its area for exiting the pan, the sliding fields bringing the dross into the corner of the pan where a conveyor belt is found, which removes the dross out of the pan into a container which collects them. In its case, entering the strip into the galvanization bath is performed, as this is often the case, inside a tube immersed in the bath and connected upstream to the annealing oven, and the dross which have decanted at the surface of the bath, cannot come into contact with the surface of the strip in this area. It is therefore sufficient to place inductors in the surroundings of the area where the strip exits.

JP-A-10-053850 teaches that screens should be positioned parallel to the strip in its entrance area in the pan, and inductors with a sliding field should be positioned in the vicinity of the two ends of each screen. The thereby generated magnetic fields give the possibility of attracting the dross out of the area comprised between the screens and including the strip.

In the case when there is no robot, such devices anyway make the work of the operator easier, who has only to act in the area of the pan, the surface of which is relatively limited.

SUMMARY OF THE INVENTION

However experience shows that the efficiency of these devices would benefit from being further improved. In particular, removal as complete as possible of the dross without human intervention should be able to be achieved, and this with a minimum of inductors. Optimally, a single inductor might be sufficient if the pan has small dimensions.

An object of the present invention is to propose a method and a device for moving away low density dross floating on the surface of the galvanization bath guaranteeing better efficiency than the known devices, by using a minimum of inductors.

For this purpose, the present invention provides a hot-dip galvanization method for a running steel strip in a bath of liquid metal, such as zinc, or a metal alloy contained in a pan, according to which the dross which are formed during galvanization, float at the surface of the bath, are moved away from the surface of the strip by means of at least one inductor, each inductor producing a sliding electromagnetic field oriented along a given direction and generating a magnetomotive force, the whole of said magnetomotive forces moving said dross towards a container intended to collect them and/or towards an area of the surface of the bath from which they are discharged, characterized in that, for at least one of said inductors, said direction of its sliding electromagnetic field is intermittently reversed so as to modify the flows of the dross inside the pan.

Among said inductors, it is possible to position at least two of them along the area where the strip exits the bath and the direction of their respective magnetic fields is intermittently reversed.

The present invention also provides a facility for hot-dip coating a steel strip, including a pan containing a liquid metal or metal alloy bath in which runs the strip, and at least one inductor, each inductor generating an electromagnetic field and magnetomotive forces contributing to bringing the dross generated during the coating into the vicinity of a container intended to receive them and/or into the action area of a robot or an operator who brings them into said container, characterized in that at least one of said inductors includes a device allowing reversal of the direction of the electromagnetic field generated by said inductor.

It may include at least two inductors located on either side of the area where the strip exits the bath, and said inductors each include a device for reversing the direction of the electromagnetic field which it generates.

Said inductors may be mounted on brackets allowing adjustment of their place above the pan and of their distance from the surface of the bath.

Said facility may include automated devices for servo-controlling the distance between each of the inductors and the level of the surface of the bath.

According to an embodiment, two inductors frame the strip in its area where it exits the bath, so as to move the dross away from the surfaces of the strip by having them move parallel therewith, and two inductors are each positioned along a wall of the pan, substantially in the extension of the two other inductors.

In this case, the pan containing the bath has a generally rectangular shape, the container in which the dross are collected, and/or the action area of the robot and/or of the operator from which they are discharged, is placed in a corner of the pan opposite to one of the inductors, and one inductor intended to orient the dross towards said container is placed in the corner of the pan opposite to the other one of the inductors.

The facility may include means for controlling the reversal of the direction of the electromagnetic field generated by at least one inductor, which are themselves subordinate to a device allowing evaluation of the amount of accumulated dross in at least one area of the pan and determination of the moment when such reversal is desirable.

At least one of said inductors may be a three-phase linear motor.

Preferably, at least one of said three-phase linear motors is of the type in which the coils surround the magnetic core.

As this will have been understood, the invention is based on the use of inductors with a sliding field, for which at least one of them has the possibility of intermittently varying the direction of the sliding field during their use, therefore the direction of the magnetomotive force which causes displacement of the dross. Optionally, if the pan containing the liquid coating metal is of small dimensions, the presence of a single inductor may be sufficient, if the direction of its sliding field according to the invention may be reversed intermittently.

This change in the direction of the field gives the possibility of not having a constant configuration of the preferential paths for circulation of the dross at the surface of the bath.

Indeed, the inventors noticed that such constancy of the circulation paths was detrimental for the efficiency of the electromagnetic device driving the dross. It leads to the creation of dead areas and of closed recirculation loops, localized in certain areas of the pan. The dross therefore tend to remain there or be accumulated there, and therefore they cannot be removed by the robot if the action area of the latter does not concern the dead areas and the areas where recirculation loops are located. If they are further away from the container collecting the dross, an operator has to bring them into the container or into the action area of the robot, with all the drawbacks which were mentioned earlier in terms of safety and working conditions.

The reversal (performed either at regular intervals or not) of the direction of the field generated by at least one inductor, preferably at least by inductors framing both sides of the strip in its penetration area in the pan, allows modification of the circulation path of the dross. By doing this, the dead areas and the recirculation loops which may have been established when the fields had a given direction, are <<broken>> by the reversal of this direction, and the dross which were possibly accumulated therein are brought back into the circulation circuit which leads them towards the action area of the robot, or even directly to the container which collects them. Therefore no human intervention for carrying out this recirculation of the dross is necessary. Also, the number of inductors which would be required for discharging the dross present on the whole of the surface of the bath may be reduced, being aware that it is not obviously necessary that a given area of the pan, in particular those located relatively far from the strip, be permanently concerned by the circulation streams.

BRIEF DESCRIPTION OF THE DRAWINGS

The invention will be better understood upon reading the description which follows, given with reference to the following appended figures.

DETAILED DESCRIPTION

Figure 1:
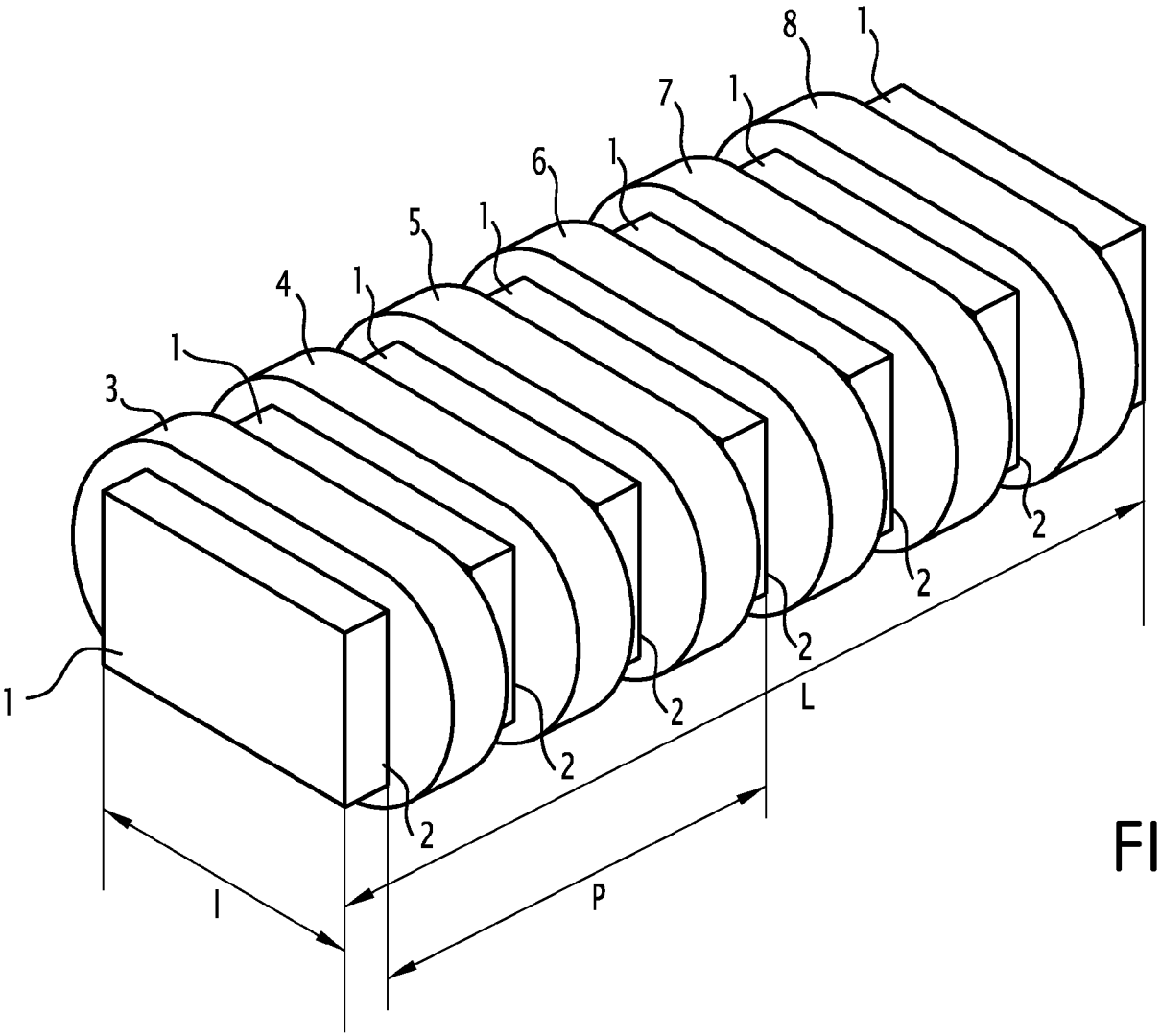
FIG. 1 illustrates an exemplary linear motor according to the present invention.

The general design of three-phase linear motors which, according to a preferred embodiment of the present invention, ensure the generation of sliding fields, is standard, but their dimensioning and their characteristics should be appropriate for the needs of the facility. One constraint is in particular obtaining a satisfactory efficiency of the sliding field when the motor is placed at a distance from the galvanization bath, optimally comprised between 20 and 100 mm, distance at which it is generally avoided that the surface of the bath come into contact with the motor, or that projections of liquid zinc come and deteriorate it.

Theoretically, a motor-bath distance from 1 to 350 mm is possible (it should also be adjusted depending on the pole pitch and on the power of the motor), being aware that the smaller this distance, the higher is the efficiency of the motor, everything being equal furthermore. But the geometry and the specific operating conditions of the galvanization facility have to be considered for selecting the optimum distance. The motors are moreover optimally mounted each on a bracket which allows adjustment of their exact location above the bath, including in height, according to the instantaneous needs of the application of the invention, which may vary according to various parameters such as:

- the running speed of the strip and its variations, which generate more or less substantial perturbations at the surface of the bath;
- the formation rate of the dross, which moreover depends inter alia on the running speed of the strip, and which, when it is significant because the strip is running fast, may require maximum efficiency of the motors for moving the mass away from the strip; it will then be beneficial to place the motors as close as possible to the surface of the bath.

The dimension in length and in volume of each motor should be such that the motor may find its place in the production line, taking into account the usual dimensions of the pan, of the strip and of the available space for implanting the motors above the pan, especially when the intention is to implant them on a pre-existing facility. Practically, the length of the motor is from 200 to 2,000 mm, its width from 100 to 1,000 mm and its height from 50 to 600 mm.

The length and the width of the motor define its active surface: the larger the active surface, the larger is the area swept by the motor, but also the more significant is the congestion of the motor, which may make its setting up into place difficult. Of course, all the motors of a same facility are not necessarily identical. The selection of the dimensions of the motor is adapted to the size of the area which it should sweep. Optimally, the motors framing the strip have a length of the order of the width of the strip in order to guarantee that the dross will be moved away from the whole of the area where the strip penetrates into the galvanization bath. But this condition is not always fulfilled on facilities intended for treating strips with diverse widths (from 600 to 2,000 mm for example). In order to find a remedy for this, the following may be considered:

- either having several sets of motors, with different widths, and which may be rapidly changed between two galvanization operations for strips of different widths;
- or, using several motors placed side by side and which may be started up or shut down depending on the width of the strip to be coated.

The pole pitch of the motor, i.e. the distance between two coils powered with the same phase, may vary from 50 to 700 mm. It corresponds to the action area of the magnetic field. The more the pole pitch is reduced, the more it is necessary to place the motor close to the surface of the bath in order to obtain a given efficiency for driving the dross. Placing the motor at 100 mm of the surface of the bath is generally accompanied by selecting a pole pitch of the order of 300 mm considering the other preferred characteristics of the motors.

The operating frequency of the motors may range from 1 to 500 Hz. It has an influence on the direction of the magnetomotive force in liquid Zn, as this was seen earlier. The force is optimally as tangential as possible relative to the surface of the bath, so as not to generate any perturbation out of the close vicinity of the surface (in particular, a perturbation which would tend to put back in place the dross having decanted at the bottom of the pan or those floating at the surface, into the core of the bath) and ensure a displacement as efficient as possible of the dross floating at the surface. Moreover everything being equal, notably the pole pitch, the electromagnetic force is all the more tangential since the frequency is low.

The intensity of the current flowing through each notch of the motors should be sufficient for generating a magnetomotive force from 1,000 to 20,000 ampere-turns, being aware that for a given winding, the higher the intensity of the current, the greater is the generated magnetomotive force.

FIG. 1 schematically illustrates a three-phase linear motor of a type known per se, which may be used as an inductor within the scope of the invention. Conventionally it includes a magnetic core 1 of length L and of width I formed by an assembly of soft iron sheets. Soft iron is used for maximizing the magnetic flux, and the sheet construction makes it possible to reduce the occurrence of Foucault currents, and therefore losses by the Joule effect. The core includes the two slots 2 in which are placed electric conductors forming coils 3-8, these coils 3-8 being themselves connected with each other in order to form windings. In the illustrated example, this is a three-phase motor, including three windings of two coils positioned alternately. The coil 3 is therefore connected to the coil 6, the coil 4 is connected to the coil 7 and the coil 5 is connected to the coil 8. Each coil 3-8 is powered with a phase shift of $2\pi/3$ for generating the sliding magnetic field which will generate the magnetomotive force moving the dross along the same direction as the field. The coils 3-8 may be cooled with an internal circulation of water.

Figure 2:
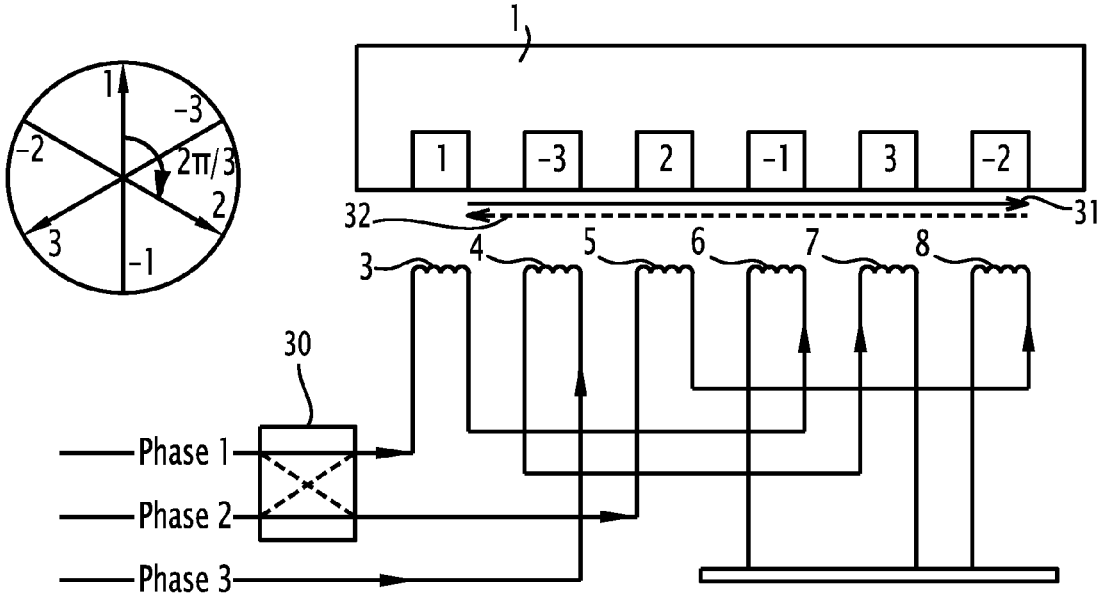
FIG. 2 illustrates the electric diagram of the linear motor of FIG. 1.

FIG. 2 shows the electric diagram of the motor, with the star connection showing the alternation of the connections of the coils.

For easily applying the invention, a phase inverter 30 is provided, which allows in a single actuation operation, modification of the connections of the coils connected to the phases 1 and 2 (in the illustrated example the coils 3, 5, 6, 8) respectively so as to be able to instantaneously reverse the direction of the sliding field, being aware that the connections of the coils 4, 7 connected to the phase 3 remain unchanged. Thus, in the configuration illustrated in solid lines in FIG. 2, wherein the coils 3 and 6 are connected to the phase 1, and the coils 5 and 8 to the phase 2, the field slides from left to right according to the arrow 31. In the configuration illustrated in dotted lines in FIG. 2 wherein the coils 3 and 6 are connected to the phase 2 and the coils 5 and 8 are connected to the phase 1, the field slides from right to left according to the arrow 32.

The pole pitch of the motor, i.e. the distance"p" between two coils powered with the same phase, for example the coils 3 and 6 in the illustrated example, is, as stated, from 50 to 700 mm. A pole pitch of 300 mm for a motor with a length of 600 to 700 mm proves to be a good compromise between the different requirements to be reconciled:

- a sufficiently long pole pitch so that it is not necessary to place the motor at a too reduced distance from the galvanization bath, which may damage it;
- a sufficiently reduced pole pitch so as not to lead to a motor for which the length would be excessively large.

Figure 3:
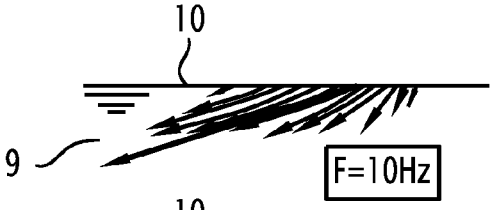
FIGS. 3 to 5 schematically illustrate the changes in the orientation of the magnetomotive forces generated by the linear motor of FIG. 1 versus the frequency of the current which flows through it.
Figure 4:
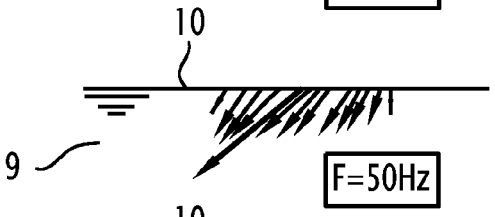
Figure 5:
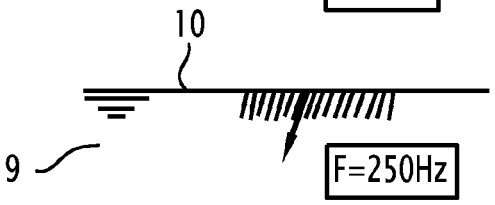

FIGS. 3 to 5 show the magnetomotive forces and their orientations in the galvanization bath 9 for frequencies of the current flowing through the motor of 10 Hz (FIG. 3), 50 Hz (FIG. 40) and 250 Hz (FIG. 5). The arrows illustrate, depending on their orientations and on their length, the preferential directions of said forces and of their intensities. It is seen that, as stated, the lower the frequency, the more the magnetomotive force is exerted tangentially to the surface 10 of the bath, and for an equal intensity of the current, is therefore efficient for moving the dross in the desired direction. But a low frequency leads to low intensity of the magnetomotive forces. The selection of the frequency of the current also has to be carried out in combination with that of the pole pitch in order to obtain the geometry of the most favorable facility towards its proper operation. Finally having a relatively low frequency and a relatively high pole pitch is estimated to be preferable so as not to be forced to place the motor at a too small distance from the bath, in order to obtain a magnetomotive force with a nevertheless adequate intensity, and which is mainly exerted along an efficient direction for proper circulation of the dross. A current of frequency 10 Hz, a pole pitch of 300 mm, a motor with a total length of 600 to 700 mm including six coils with 96 turns, each being crossed by a current of intensity 150 A, and therefore providing a magnetomotive force of 15,000 ampere-turns represents a good compromise if it is placed at a distance from 50 to 100 mm from the surface 10 of the bath 9.

The most standard linear motors include a flat winding, with flat coils crossing the core (see for example document EP-A-0 949 749). But for greater compactness of the motor, in particular in width, it is preferable to give it the configuration schematically illustrated in the figures, wherein the coils 3-8 are positioned around the core 1. Document "Fluid flow in a continuous casting mold driven by linear induction motors" (ISIJ International, 2001, Vol. 41 No. 8, pp 851-858) describes such linear motors in more detail.

Figure 6:
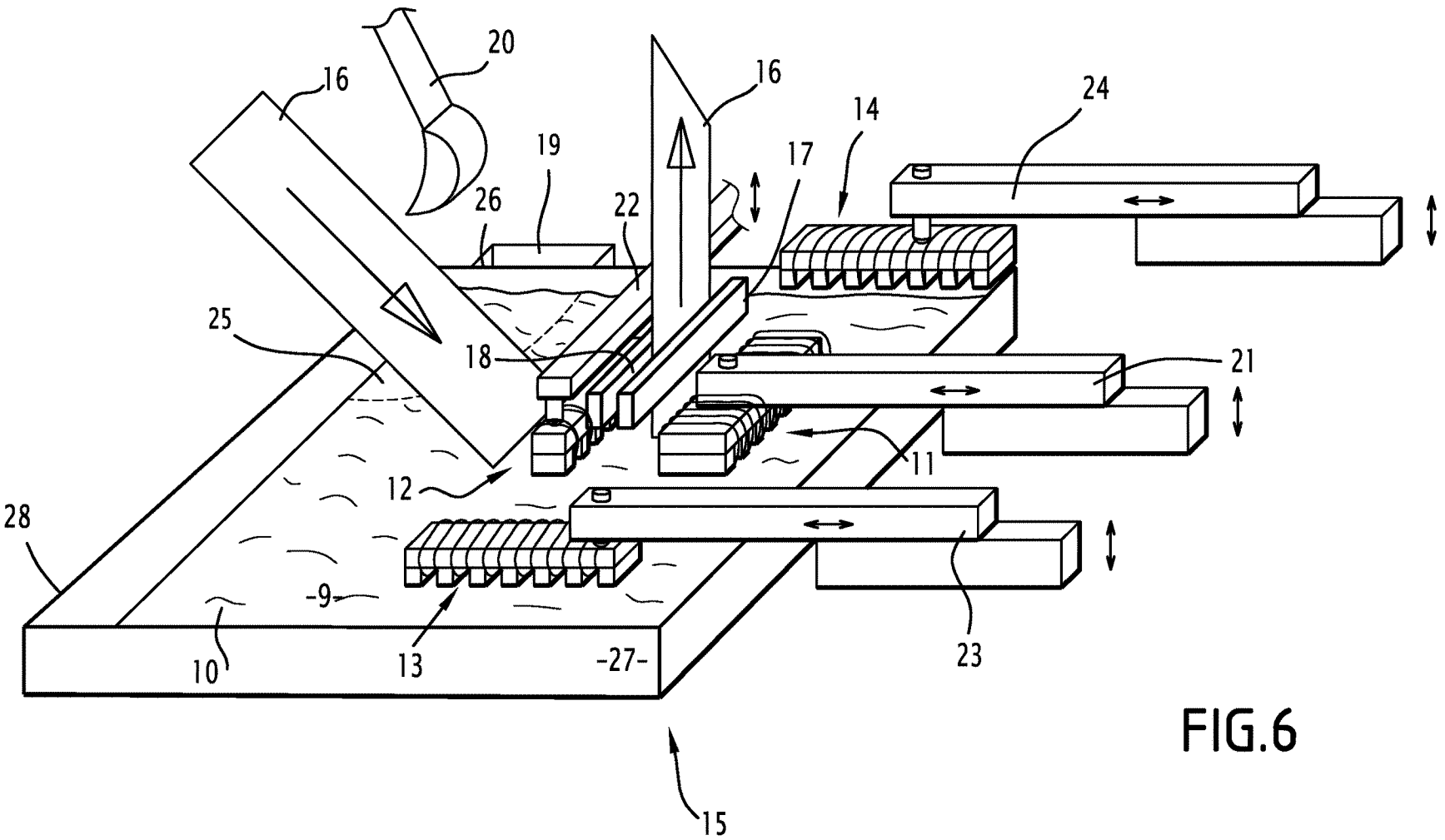
FIG. 6 schematically illustrates in a perspective view an exemplary galvanization facility including a motor according to the present invention.

FIG. 6 schematically illustrates a galvanization facility equipped, in the illustrated example, with four linear motors 11-14 of the type of the one of FIG. 1, and capable for applying the invention. Conventionally, this facility includes a pan 15 with a generally rectangular shape, provided with means for maintaining the temperature of the bath 9 of liquid zinc or more generally, of a zinc alloy (or as a reminder, any other metal or metal alloy which may be used for coating the strip 16), which it contains. The running strip 16 to be galvanized penetrates into the bath 9 along an oblique direction. Very often, as stated, this penetration is in fact carried out inside a protected tube, connected in its upstream portion to the annealing line which allowed adjustment of the temperature of the strip to a value close to that of the bath 9. For the sake of clarity, this tube has not been illustrated in FIG. 6, as well as in FIGS. 7, 8 and 9. The strip 16 passes around a roller located inside the tank 15, and emerges from the bath 9 vertically, coated with its galvanization layer, towards the other elements of the galvanization facility, known per se and not having any influence on the design of the invention. As this is known, the galvanized strip 16 passes, upon exiting the bath 9, between two gas blowing devices 17, 18 which adjust the thickness of the coating on each of the surfaces of the strip 16 and cool it down, therefore contributing to proper solidification. In order to collect the dross, a container in which the dross may be collected after having been pushed therein by means of the motors 11-14, may be placed in a corner of the pan 15. Or else, as illustrated, a robot 20 positioned in the vicinity of the pan 15 may be moved in all the spatial directions in order to extract the dross from the bath 9 and to send them into a container 19 placed beside the pan 15.

The linear motors 11-14 are positioned on brackets 21-24 which allow modification of their respective positions above the bath 9 in order to optimize:

- the location of the action area of each motor 11-14;
- and the vertical distance between the surface 10 of the bath 9 and each of the motors 11-14.

Indeed, because of the gradual consumption of zinc during galvanization, the level of the bath 9 tends to be lowered during the operation, and if the distance between the motor 11-14 and the surface 10 increases, the magnetomotive force decreases. A gradual downward lowering of the motor 11-14 by its bracket 21-24 gives the possibility of maintaining this distance constant, therefore keeping the magnetomotive force constant in direction and in intensity, everything being equal furthermore. Another means for acting on the magnetomotive force is to increase the intensity of the current flowing through the motor 11-14. Of course, it is possible to combine an adjustment of the distance between the motor 11-14 and the surface 10 of the bath 9 and an adjustment of the intensity of the current for controlling the magnetomotive force. Means may be provided for automatically subordinating the distance between each motor 11-14 and the surface 10 of the bath 9 to the variation of the level of said surface 10.

Figure 7:
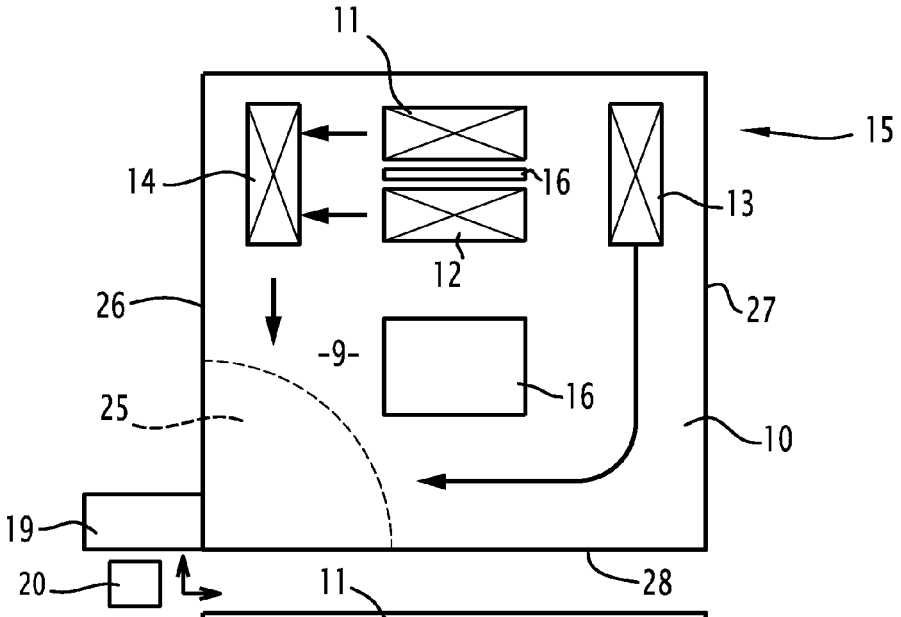
FIGS. 7 and 8 schematically show in a top view the facility of FIG. 6 for two possible configurations of the flow of the dross which may be achieved according to the invention.
Figure 8:
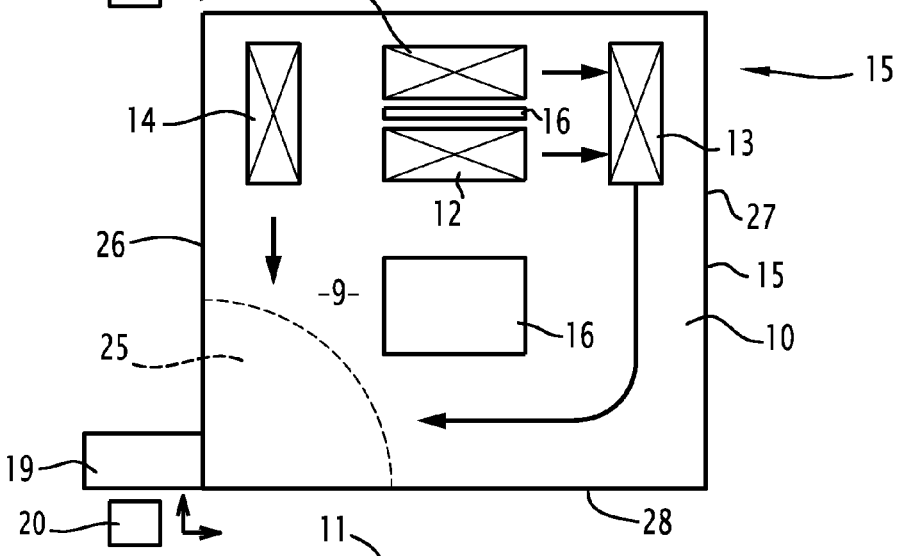

The positioning of the different main elements of the facility as illustrated in FIG. 6 also appears in FIGS. 7 and 8. Two motors 11, 12 frame the strip 16 in its area where the strip exits the bath 9, so as to move the dross away from the surfaces of the strip 16 by causing their movement parallel therewith. Two motors 13, 14 in the illustrated non-limiting example, are each positioned along a side wall of the pan 15 and parallel to it, substantially in the extension of two other motors 11, 12, so as to have the dross penetrating into their respective action areas run alongside said wall, and so as to send them towards the action area 25 of the robot 20 which pushes them into the container 19 located in close proximity to the pan 15. In the illustrated example, the action area 25 of the robot 20 is located opposite to one 14 of the motors positioned along a side wall of the pan 15.

The parallelism of the side walls of the pan 15 and of the motors 13, 14 as illustrated in FIGS. 6, 7 and 8 is, as stated, only a non-limiting positioning example. The orientation of these motors 13, 14 should be optimized according to the specific configuration of the pan 15 and of the specific location of the action area 25 of the robot 20. This optimization may lead to positioning at least one of these motors 13, 14 obliquely relatively to the side wall of the pan 15 to which it is close.

The inventors noticed that the efficiency of such a system, operating continuously with substantially constant magnetomotive forces at least in direction, did not allow maximum efficiency to be attained for removing the dross.

Indeed, because of the stability of the flows at the surface of the bath 9, in the long run, dead areas are created where the dross will accumulate and remain immobile without being able to captured by one of the motors 11-14, and also areas in which the dross circulate in loops, having few possibilities of escaping in order to join up with the normal circulation flow which will lead them into the action area 25 of the robot 20 (or directly into the container 19 if the latter is placed in the actual pan 15). An accumulation of the dross in certain areas is therefore observed, which may end up by forming a source of pollution for the whole of the bath 9 and deteriorate the quality of the galvanization.

An object of the present invention is to provide at least one of the motors 11-14 with a means allowing reversal of the direction of the electromagnetic field which it generates, therefore the direction of the magnetomotive force which causes displacement of the dross. This reversal may take place systematically at predetermined time intervals and be controlled manually or automatically, preliminary experiments having allowed determination of the optimum frequency with which this reversal should be carried out depending on the galvanization conditions (notably on the running speed of the strip 16, the nature of the bath 9 . . . ). It may also take place in an irregular way, at moments determined by the operator of the facility, or by any automated device operating, for example, while being subordinate to means for evaluating the amount of accumulated dross in determined area(s) of the pan 15.

This evaluation of the amount of accumulated dross may be provided, for example, by analyzing images captured by cameras (infrared cameras or others) aiming at the potential accumulation areas of the dross. It allows an operator or an automatic device for managing the galvanization facility, to estimate that the accumulation of the dross in one or several places of the surface 10 of the bath 9 is on the point of becoming excessive or is already excessive, and that it is therefore desirable to proceed with said reversal of the direction of the field of at least one of the motors 11-14.

The reversal of the direction of the magnetomotive force associated with the relevant motor(s) 11-14 causes a transient perturbation of the circulation of the dross, which thus gives the possibility of stirring areas which were stable previously (dead areas or recirculation loops). This stirring brings back the dross which are found in these areas within the new preferential path for circulation of the dross which is thereby generated, and said dross may be removed. This new recirculation path in turn will generate new dead areas and recirculation routes, but they may be "broken" in the same way by subsequent reversal of the direction of the field generated by at least one of the inductors 11-14.

These means for reversal of the field of the inductor 11-14 may very simply be formed by a switch which changes the powering of the various coils 3-8. For this, as seen and illustrated in FIG. 2, it is sufficient to provide a phase switch 30 which changes the powering of the coils of the motor. This switch 30 is set up in the electric cabinet for controlling the facility and may be remotely controlled by an operator and/or by an automatic system. The change in the direction of the sliding field is instantaneous.

In the case illustrated in FIGS. 7 and 8, these are the motors 11, 12 which surround the strip 16 in the exit area of the bath 9 which are equipped with means for reversing the direction of the electromagnetic field which they generate.

In the case of FIG. 7, a first operating condition of the motors 11-14 is illustrated, wherein the motors 11, 12 both drive the dross towards the left side wall of the pan 15. They are again taken up therein by the field generated by the motor 14 located along this left side wall 26, and sent towards the container 19 if the latter is integrated to the pan 15, or as illustrated, into the action area 25 of the robot 20. Simultaneously, the motor 13 located along the right side wall 27 of the pan 15 sends the dross which its electromagnetic field captures along the right side wall 27 towards the action area 25 of the robot 20. These dross also tend to be diverted by the front wall 28 of the pan 15 towards the action area 25 of the robot 20. The different arrows illustrated in FIG. 7 (as well as in FIGS. 8 and 9) show the displacements of the dross induced by the magnetomotive forces generated by the various motors 11-14.

FIG. 8 illustrates a second operating condition of the motors 11-14, in which the directions of the fields generated by the motors 11, 12 framing the strip 16 after a certain period of use of the configuration of FIG. 7, have been, according to the invention, reversed relatively to the case of FIG. 7. This time, the dross found in the vicinity of the strip 6 are oriented towards the motor 13 located along the right side wall 27 of the pan 15. The motors 13, 14 operate like in the case of FIG. 7. This reversal is already sufficient for generating movements of the dross at the surface 10 of the bath 9 which are capable of "breaking" the dead areas and recirculation areas created in the configuration of FIG. 7.

When the accumulation of the dross in the new dead areas and generated recirculation loops will be at the point of becoming excessive, as described earlier, there will be a transition into the configuration of FIG. 7 either manually or automatically.

In the illustrated example, the two motors 11, 12 framing the strip 16 both drive the dross in the same direction. But this configuration is not mandatory, it is possible to provide, if the localization of the dross to be moved requires this, that the directions of the fields of said motors 11, 12 be opposite and this permanently or temporarily.

Also, in the illustrated example, both motors 11, 12 framing the strip 16 have the same length and exactly face each other. But this configuration is not mandatory and provision may be made for having these motors 11, 12 have different lengths and/or be shifted relatively to each other, if it is found that this is beneficial to proper removal of the dross in the particular configuration of the pan 15 used.

Figure 9:
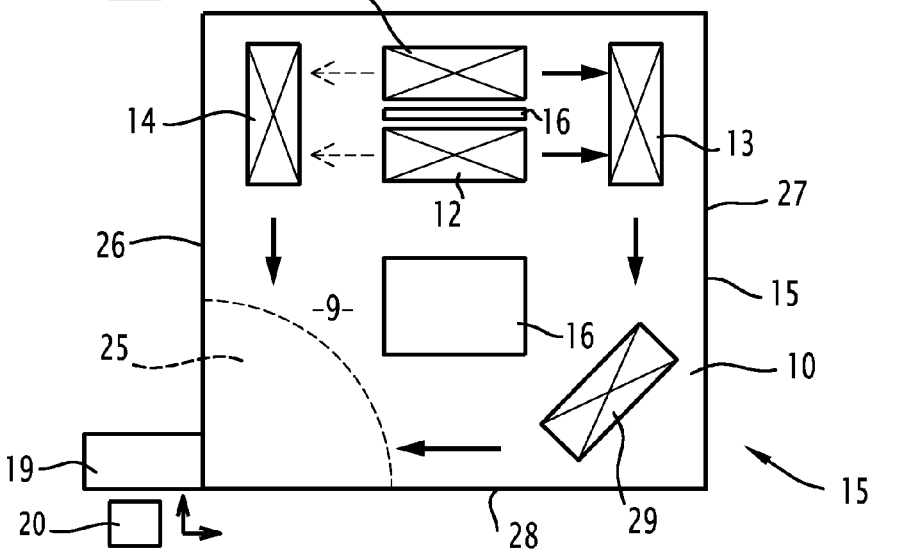
FIG. 9 schematically shows in a top view an alternative of the facility of FIG. 6, in which an additional linear motor is used.

FIG. 9 schematically shows an another preferred embodiment, in which a fifth motor 29 positioned obliquely in the right front corner of the pan 15 has been added. It is therefore located on the path of the dross pushed by the motor 13 located along the right side wall 27 of the pan 15, and has the function of reinforcing the effect of this motor 13 in delivering the dross towards the action area 25 of the robot 20. It is thus possible to reduce the size of the action area 25 of the robot 20 and generally increase the efficiency of the discharge of the dross out of the vicinity of the strip 16 and towards the action area 25 of the robot 20. The motors 11, 12 framing the strip 16 have, like in the case of FIGS. 7 and 8, their electromagnetic fields alternating in one or the other direction.

It is also possible to contemplate that the different motors 11-14 or 11-14, 29 or at least some of them, be moveable during operation in a direction which allows them to accompany the displacement of the dross, and thereby assist with the displacement of a given group of dross for a longer period than if the motor 11-14 or 11-14, 29 only gave them a single pulse, when these dross are located below the initial action area of the motor 11-14 or 11-14, 29.

Of course, the examples of FIGS. 6-9 are non-limiting, both from the point of view of the number of motors as well as of their positioning. It may also be provided that motors other than the motors 11, 12 framing the strip 16 (in addition to them or instead of them) may have reversible action directions. But the surroundings of the exit area of the strip 16 being the most sensitive in terms of risks of pollution of the zinc deposit, or of a coating metal alloy generally, by the dross (if the entrance area of the strip is protected with a tube connected to the annealing oven, as this is often the case). It is clear that preferably, motors with great efficiency should be positioned there. And especially if these motors 11, 12 are the most powerful ones of the device, preferably these are the ones for which reversal of the action directions will be the most beneficial. It is also possible to provide the replacement of either one or both of these two motors 11, 12 for which the length is, if possible, of the same order as the width of the strip, with several motors of smaller size positioned beside each other and for which the magnetic fields would have the same direction. This may be the way for solving a congestion problem which may be posed by the implementation of a single motor of large size in the bath, particularly in the case of the motor 12 located between the area where the strip 16 enters the bath 9 and the area where the strip 16 exits. This may also be a way of easily varying the size of the action area of the motors framing the strip 16 depending on the width of the strip 16 if the latter may assume several different values on a same coating facility. For this, it is sufficient to electrically shut down the motors which jut out beyond the width of the strip 16, or even also displace them away from the pan 15.

Of course, the examples which have been described are non-limiting and other positions of the inductors may be contemplated, in particular when the area where the strip 16 penetrates into the bath 9 should also itself be free of dross if the strip 16 is in the open air, or if the container 19 collecting the dross and/or the action area 25 of the robot 20 are placed elsewhere than where they were in the illustrated examples. One skilled in the art will be able to adapt the number and the positioning of the inductors to the particular geometry of his/her coating facility, the essential point being the existence of the possibility of intermittently reversing the direction of action of at least one of the inductors in order to avoid perpetuation of the dead areas and of the recirculation loops at the surface 10 of the bath 9, which promotes accumulation of dross.

For pans 15 of small dimensions, it may be contemplated to only use a single motor for which the direction of the sliding field which it generates is varied intermittently. In this case, it may be appropriate to provide two containers 19 each located in the extension of said motor but opposite to each other, in order to collect the displaced dross during periods for which the field of the motor slides in one or the other direction.

As a non-limiting example, for applying the invention on a facility for galvanization of steel strips with a width from 650 to 1,350 mm normally running at 60-120 m/min but being capable of running at a speed above 200 m/min by using the invention, it is possible to use a rectangular pan 15 of 4×3.20 m and four motors 11-14 positioned like in FIGS. 6 to 8. These motors are powered with a current of frequency 10 Hz. They each have a pole pitch of 300 mm, a total length from 600 to 700 mm and each include 6 coils with 96 turns, a current of intensity 150 A flowing through each of them, and therefore providing a magnetomotive force of 15,000 ampere-turns.

What is claimed is:

1. A method for hot-dip coating of a steel strip running in a bath of liquid metal or of a metal alloy contained in a pan, during which dross are formed during the coating and float at a surface of the bath comprising the steps of:

moving the dross away from a surface of the strip by at least one inductor and accumulating the dross in at least one area of the pan;

producing a sliding electromagnetic field oriented along a given direction and generating a magnetomotive force by each inductor;

displacing the accumulated dross via the magnetomotive forces towards at least one container or towards at least one area of the surface of the bath from which the dross are discharged;

reversing intermittently the given direction of the sliding electromagnetic field for at least one of the inductors so as to modify flows of the dross inside the pan.

2. The method according to claim 1, wherein at least two inductors are positioned along an area where the strip exits the bath and the direction of their respective electromagnetic fields are reversed intermittently.

3. The method according to claim 1, wherein the step of reversing includes using a phase inverter.

4. The method according to claim 1, wherein the step of reversing includes a switch.

5. The method according to claim 1, wherein the each inductor is mounted on brackets allowing adjustment of a location above the pan and a distance to the surface of the bath.

6. The method according to claim 1, further comprising adjusting the distance between each inductor and a level of the surface of the bath.

7. The method according to claim 1, wherein the at least one inductor includes four inductors, the first and second inductors frame the strip in an area where the strip exits the bath to move the dross away from surfaces of the strip by moving the dross in a direction parallel therewith and the third and fourth inductors are each positioned along walls of the pan, substantially in an extension of the first and second inductors.

8. The method according to claim 7, wherein the pan containing the bath has a generally rectangular shape, the container in which the dross are collected or the area is located in a first corner of the pan opposite the third or fourth inductor, and in a second corner of the pan opposite to fourth or third inductor, respectively, a fifth inductor is placed to orient the dross towards the container.

9. The method according to claim 1, further comprising a device controlling the reversal of the direction of the electromagnetic field generated by the at least one inductor which is subordinate to a device for evaluating the amount of accumulated dross in at least one area of the pan.

10. The method according to claim 1, wherein at least one of the inductors is a three-phase linear motor.

11. The method according to claim 10, wherein at least one of the three-phase linear motors includes coils surrounding a core.

12. The method according to claim 1, further comprising a step of evaluating the amount of accumulated dross in the at least one area of the pan.

13. The method according to claim 12, wherein the step of evaluating the amount of accumulated dross includes the use of a camera.

* * * * *